US005891372A

United States Patent [19]

Besset et al.

[11] Patent Number: 5,891,372

[45] Date of Patent: Apr. 6, 1999

[54] METHOD OF MAKING A PERSONALIZED HELMET LINER

[75] Inventors: Christophe Besset, Plaisir; Fernand Bertheau, Elancourt, both of France

[73] Assignee: Intertechnique, Plaisir, France

[21] Appl. No.: 2,346

[22] Filed: Jan. 2, 1998

[51] Int. Cl.[6] ..... B29C 44/06; B29C 44/12

[52] U.S. Cl. ..... 264/46.5; 264/46.6; 264/222; 264/227

[58] Field of Search ..... 264/222, 227, 264/46.5, 46.6

[56] References Cited

U.S. PATENT DOCUMENTS

| | | | |
|---|---|---|---|
| 3,882,546 | 5/1975 | Morton | 264/222 |
| 4,708,836 | 11/1987 | Gain et al. | 264/227 |
| 5,324,460 | 6/1994 | Briggs | 264/222 |
| 5,376,318 | 12/1994 | Ho | 264/46.6 |
| 5,609,802 | 3/1997 | Jeng | 264/46.5 |
| 5,707,572 | 1/1998 | Kostich | 264/46.6 |

FOREIGN PATENT DOCUMENTS

| | | |
|---|---|---|
| 0210918 | 2/1987 | European Pat. Off. . |
| 2466233 | 4/1981 | France . |
| 1187993 | 4/1970 | United Kingdom . |
| 9740716 | 11/1997 | WIPO . |

*Primary Examiner*—Allan R. Kuhns
*Attorney, Agent, or Firm*—Larson & Taylor

[57] ABSTRACT

In order to make a personalised helmet liner using a rigid injection shell, a cast of the user's skull is made from a quick-setting product; the desired position of the user's head and the cast relative to a predetermined helmet reference frame is determined on an optical bench and a reference support (30) is fixed to the cast; a dummy head provided with a positioning support relative to the rigid shell is moulded in the cast by comparison with the reference support; the dummy head is placed inside the rigid shell and the dummy head and the shell are positioned relative to one another by using an indicator (31) on the support, and an expandable foam is injected into the space between the rigid shell and the dummy head.

6 Claims, 3 Drawing Sheets

METHOD OF MAKING A PERSONALIZED HELMET LINER

The invention relates to a method of making a personalised helmet liner, so as to keep the helmet shell in an exact position relative to the wearer's head.

A personalised liner of this kind is necessary whenever the position of the helmet shell must exactly reproduce the position of the head. This is the case inter alia with helmets for receiving an optical system such as a view-finder, a display or night glasses. The position and orientation of the helmet with respect to the pupil of the sighting eye and the orientation thereof must be reproducible with an accuracy of the order a millimetre and one degree of angle.

At present there are a number of methods of manufacturing a liner of this kind. The most common method consists in placing a flexible pocket between the user's head and an injection shell which represents the helmet shell. The pocket comprises a cushioning fabric for the skull, positioned relative to the shell by studs, after which an expandable foam such as polyurethane is injected into the pocket and sets in a few minutes.

This method has numerous disadvantages. The helmet user is subject to mechanical constraints (due to expansion) and thermal constraints (due to the exothermic nature of the transformation of the foam) during manufacture of the liner. Deformation and movement due to the pressure of the foam reduce the accuracy. If a liner wears out or is lost, the user must undergo the personalisation operation again.

The object of the invention is to provide a method of making a personalised liner, so as substantially to reduce the previously-mentioned disadvantages.

To this end, the invention proposes a method in which:

- a cast of the user's skull is made from a quick-setting product;
- the required position of the user's head and the cast relative to a predetermined helmet reference frame is determined on an optical bench and a reference support identifying the position to be given to the head relative to a rigid shell is fixed on the cast,
- a dummy head is moulded in the said cast and equipped with a support for positioning relative to the rigid shell, by comparison with the reference support of the cast;
- using the positioning support, the dummy head is placed inside the rigid injection shell, which has previously been equipped with a flexible pocket equipped with a cushioning cloth, and the dummy head and shell are positioned relative to one another by using an indicator on the positioning support, and
- an expandable foam is injected into the space between the rigid shell and the dummy head in order to form the liner.

It is thus possible to obtain high accuracy, since the dummy head can be firmly secured in tooling equipment. There are fewer limitations regarding the nature of the foam, since the dummy head can withstand mechanical and thermal constraints and accept longer hardening times than in the case of direct moulding. A single casting operation is sufficient for constructing a dummy head which can be used a number of times. Any deviations can be corrected by machining the dummy head or adjusting its position relative to the rigid injection shell when the liner is being moulded, without the user needing to be present.

BRIEF DESCRIPTION OF THE DRAWINGS

The previously-mentioned features and others will be clearer from the following description of an embodiment of the invention with reference to the accompanying drawings, which show the successive steps in the method. In the drawings.

DETAILED DESCRIPTION OF THE INVENTION

Figure 1:
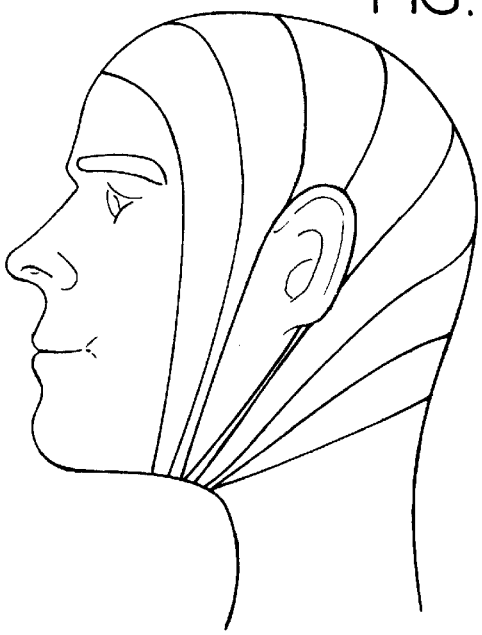
FIG. 1 is a diagram for showing the operation of casting the user's head.

The first step in the process consists in taking a cast, which can be done by various methods. Inter alia the wearer's skull can be protected by a polyethylene film, then draped in a hardenable tape of the kind conventionally used in bone traumatology (FIG. 1). Use can be made inter alia of a resin-impregnated tape such as that sold under the trade mark "SCOTCHCAST", which sets in a few minutes.

Figure 2:
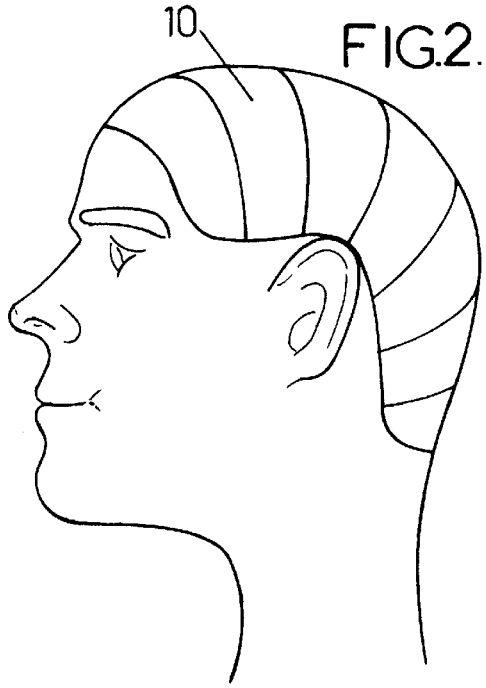
FIG. 2 is a diagram showing the cast when hardened and cut out.

When the cast has sufficiently hardened it can be cut out so as to remove the lateral portions; the final cast 10 can then be removed from the head (FIG. 2).

Since the object of the liner is subsequently to position the head accurately with respect to a reference frame associated with a helmet shell, the cast 10 will be equipped with a reference support for subsequently holding a dummy head and a rigid shell in the appropriate position during the final injection of an expandable foam.

This is done by using an optical bench provided with optical sighting means and on which a reference frame can be constructed so as to reproduce the reference frame of the helmet shell and inter alia of the view-finder which it carries. The user's head can be prevented from moving by conventional means, e.g. by clamping the jaw on to a tooth cast carried by a movable table.

Figure 3:
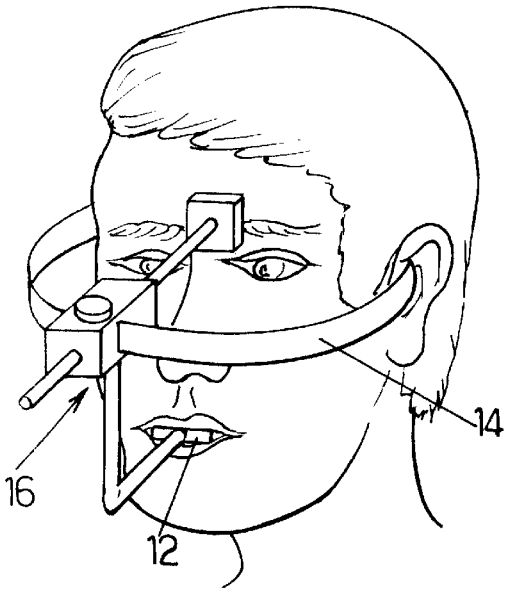
FIG. 3 is a diagram showing an operation of taking a tooth cast for subsequent adjustment of a reference support.

To this end, a tooth cast is first made in the form of a "bite board" 12, using a conventional dentist's material. As shown in FIG. 3, the bite board 12 is mounted on a facial arc 14 by a mechanism 16 for adjusting its position. When the board 12 has hardened, it accurately represents the position of the jaw relative to the skull (FIG. 3).

Figure 4:
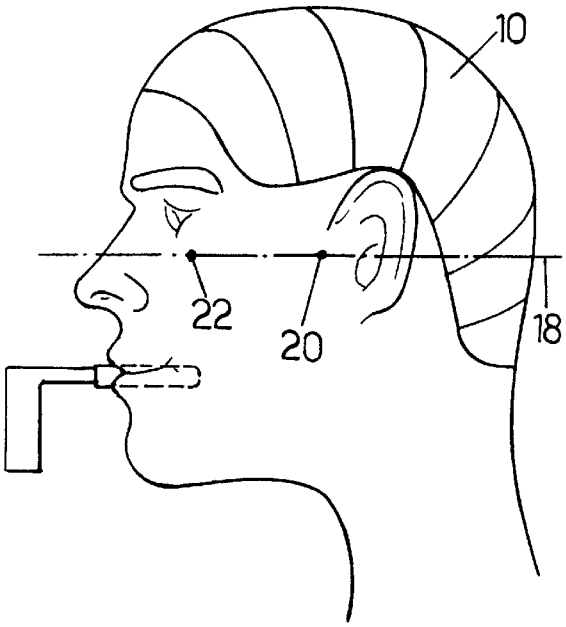
FIG. 4 shows the reference marks used for positioning the head in roll and in elevation.
Figure 5:
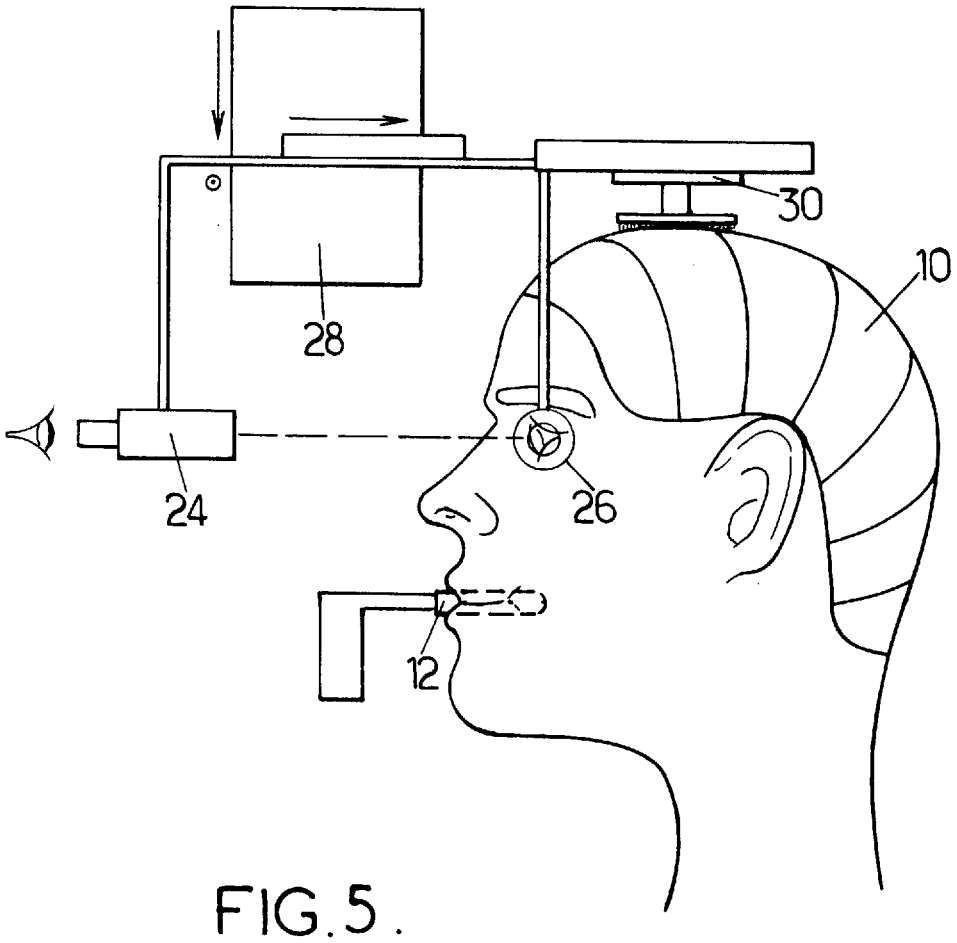
FIG. 5 shows a reference support being positioned on the cast, in a given position along pitch, roll and yaw axes relative to a sighting eye.

During a subsequent step (FIG. 4) the head is placed in a given position on an optical bench and given a forced orientation by rotating the bite board on which the wearer is clenching his teeth. Usually the head is positioned in roll and in elevation until the eye-ear plane is horizontal. The eye-ear plane is an anatomical plane which extends through the two tragi 20 and the left sub-orbital 22. This anatomical plane is used as the base of a reference frame for measuring the anthropometric quantities necessary for constructing the helmet.

The optical bench on which the operation is performed is provided with sighting means comprising e.g. a front sight 24 and a side sight 26. A cross-motion table 28 is used for moving a reference support 30 in three dimensions, and the support 30 is brought into a clearly-identified position with respect to the eye. The support 30 is then fixed, e.g. by sticking.

Figure 6:
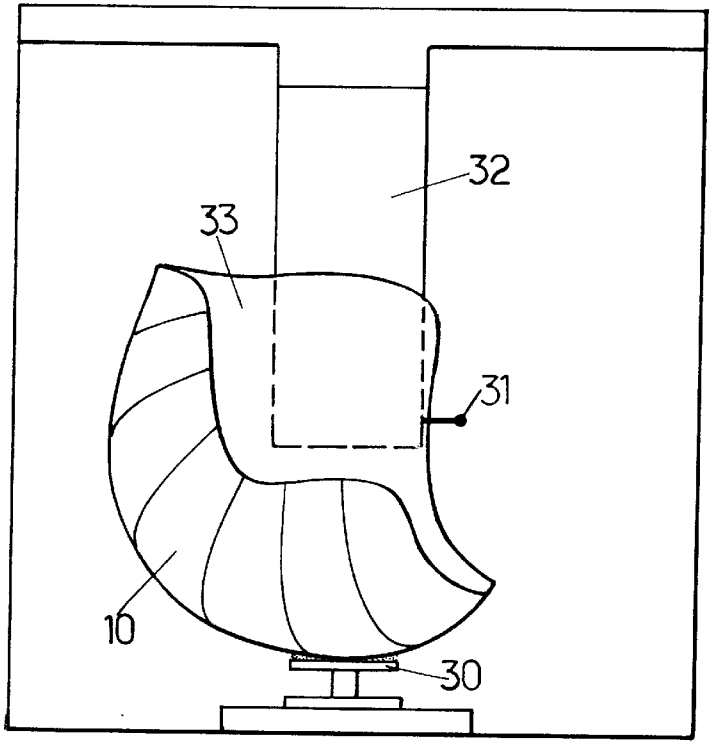
FIG. 6 shows the dummy head constructed from the cast.

The next operation is to make a dummy head 33 by moulding in the cast. To this end the reference support 30 is fixed in moulding equipment for mounting a positioning support 32 on which the theoretical position of the eye is identified by an indicator 31 (FIG. 6). The moulding material for forming the dummy head can be a casting ceramic which, after hardening and being secured to the support 32, has high geometrical stability and mechanical strength and a well-determined position relative to the reference support.

Figure 7:
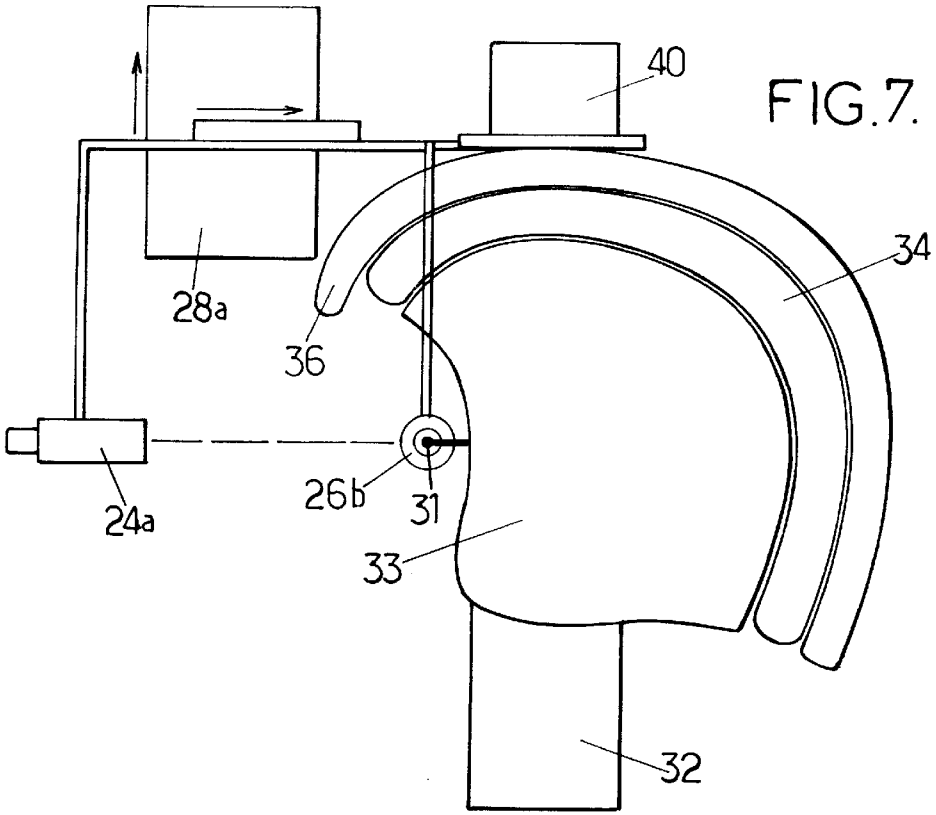
FIG. 7 shows the process of constructing a personalised liner in a rigid injection shell, using the dummy head.

The dummy head can be used to make one or more personalised liners 34 in tooling equipment (FIG. 7) which likewise comprises a front sight 24a and a side sight 26*a* for placing the dummy head 33 and the rigid injection shell 36 in a correct relative position. To this end the tooling equipment likewise comprises a table 28*a* for motion along three orthogonal axes and carrying the shell 36 on a spacer 40. The personalised liner can also be formed in a flexible pocket comprising a cushioning cloth on the side of the skull and positioning means such as studs on the side of the shell. An expandable foam such as polyurethane is injected into the pocket. The resulting liner 34 can be used as soon as it sets.

We claim:

1. A method of manufacturing a personalised helmet liner by using a rigid injection shell, characterised in that:

a cast of the user's skull is made from a quick-setting product, the required position of the user's head and the cast relative to a predetermined helmet reference system is determined on an optical bench and a reference support (30) is fixed to the cast in order to identify the position to be given to the head relative to a rigid shell, a dummy head provided with a positioning support relative to the rigid shell is moulded in the cast, by comparison with the reference support (30) of the cast, the dummy head is placed inside the rigid shell (36) and the dummy head and the shell are positioned relative to one another, using an indicator on the positioning support, and an expandable foam is injected into the space between the rigid shell and the dummy head in order to form the liner.

2. A method according to claim 1, characterised in that the expandable foam is injected into a flexible pocket provided with a cushioning cloth interposed between the rigid shell and the dummy head.

3. A method according to claim 1, characterised in that the skull cast is made by using a tape impregnated with hardenable resin and by cutting out the edges of the cast in order to take it out.

4. A method of manufacturing a personalised helmet liner of a helmet having a rigid shell and a helmet liner, comprising the steps of:

a) making a cast of a user's skull from a quick-setting product, b) making a tooth cast in the form of a bite board and securing the bite board to a facial arc by a position-adjusting mechanism, c) locating the user's head in a predetermined position on an optical bench provided with sighting means and forcing the head into a predetermined orientation by rotating the bite board, d) bringing a reference support representative of a position to be given to said rigid shell into a predetermined position with respect to an eye of the user's head, using said sighting means for identifying said position and securing said reference support to said cast, e) using said cast to mould a dummy head provided with a positioning support identifying the position of said eye and located by comparison with said reference support of the cast, f) placing the dummy head inside the rigid helmet shell and positioning the dummy head and the shell relative to one another, using said positioning support, and g) injecting an expandable foam into a space between the rigid shell and the dummy head in order to form the liner.

5. A method according to claim 4, wherein, during said locating step c), said predetermined orientation is selected for an eye-ear plane of the user's head to be horizontal.

6. A method according to claim 4, wherein, during said bringing step d), said reference support (30) is secured by sticking.

* * * * *